US007909940B2

(12) United States Patent
Ahn

(10) Patent No.: US 7,909,940 B2
(45) Date of Patent: Mar. 22, 2011

(54) DISH WASHING MACHINE WITH STEAM GENERATOR AND METHOD OF CONTROLLING SAME

(75) Inventor: In Geun Ahn, Changwon-si (KR)

(73) Assignee: LG Electronics Inc., Seoul (KR)

( * ) Notice: Subject to any disclaimer, the term of this patent is extended or adjusted under 35 U.S.C. 154(b) by 328 days.

(21) Appl. No.: 12/071,510

(22) Filed: Feb. 21, 2008

(65) Prior Publication Data

US 2008/0295865 A1 Dec. 4, 2008

(30) Foreign Application Priority Data

May 30, 2007 (KR) ..... 10-2007-0052694
May 30, 2007 (KR) ..... 10-2007-0052695

(51) Int. Cl.
*B08B 3/02* (2006.01)

(52) U.S. Cl. ..... 134/56 D; 134/57 D; 134/58 D; 134/104.1

(58) Field of Classification Search ..... None
See application file for complete search history.

(56) References Cited

U.S. PATENT DOCUMENTS

2005/0034489 A1* 2/2005 Oh et al. ..... 68/5 C
2007/0283505 A1 12/2007 Siong et al.

FOREIGN PATENT DOCUMENTS

| | | | |
|---|---|---|---|
| CA | 2 569 288 | A1 | 5/2007 |
| EP | 1 544 345 | | 6/2005 |
| EP | 1 790 269 | | 5/2007 |
| KR | 20-1994-0008403 | | 10/1998 |
| KR | 20-0257526 | | 12/2001 |
| KR | 10-2006-0120759 | A | 11/2006 |
| KR | 10-2006-0124266 | | 12/2006 |
| KR | 10-0682654 | B1 | 2/2007 |
| KR | 10-0717472 | B1 | 5/2007 |
| KR | 10-0717474 | | 5/2007 |
| KR | 10-0717475 | B1 | 5/2007 |

OTHER PUBLICATIONS

Machine Tranlation of KR 10-0682654 by Yoon et al., published Feb. 15, 2007.*
Machine Translation of KR 10-2006-0120759 by Ahn, published Nov. 28, 2006.*

* cited by examiner

*Primary Examiner* — Michael Kornakov
*Assistant Examiner* — Ryan Coleman
(74) *Attorney, Agent, or Firm* — McKenna Long & Aldridge LLP

(57) ABSTRACT

Dish washing machine including a steam generator, which supplies steam during the washing procedure to aid in the washing of items in the dish washer, and a method for controlling the same. The dish washing machine capable of discharging residual water from the steam generator to remove impurities in the water contained therein. Discharging the residual water in the steam generator may be performed prior to, during or after the washing procedure in such a manner so as to protect other components from damage due to the high temperatures associated with the residual water.

7 Claims, 3 Drawing Sheets

DISH WASHING MACHINE WITH STEAM GENERATOR AND METHOD OF CONTROLLING SAME

This application claims the benefit of Korean Patent Application No.10-2007-0052695 and Korean Patent Application No. 2007-0052694, both of were filed on May 30, 2007. Both applications are hereby incorporated by reference as if fully set forth herein.

BACKGROUND OF THE INVENTION

1. Field of the Invention

The present invention relates to a dish washing machine and a method for controlling a dish washing machine that includes a steam generator, wherein, the washing machine is adapted to discharge residual water in the steam generator.

2. Discussion of the Related Art

Generally, dish washing machines are well known as devices that automatically wash dishes in the washing compartment of the dish washing machine by spraying wash water, under high pressure, on the dishes, thus, removing foreign matter such as food particles and food residues attached to the surface of the dishes. It is understood that dish washing machine's wash items other than dishes, such as glassware, pots, pans, utensils and the like. However, for ease of discussion, the following disclosure will refer only to dishes.

One important factor associated with dish washing machines is how effectively the machine removes food particles and food residues on or attached to the surface of dishes. In order to improve washing capability, dish washing machines increase the force (i.e., the spray pressure) of the wash water to more effectively remove foreign matter form the surface of the dishes. However, if the spray pressure of the wash water is too high, the dishes may break or otherwise become damaged. Further, when washing dishes with increased spray pressure, the dish washing operation is less efficient because the amount of wash water required increases.

SUMMARY OF THE INVENTION

Accordingly, the following disclosure describes a dish washing machine and a method of controlling a dish washing machine that substantially obviates one or more of the problems associated with the related art. More specifically, described herein is a dish washing machine that includes a steamed generator, and a method for controlling the same, where the dish washing machine safely, effectively and efficiently washes dishes without having to employ excessive spray pressure or an excessive amount of wash water. Still further, the following disclosure describes a dish washing machine and a method for controlling a dish washing machine that comprises a steam generator, where the washing machine is capable of discharging water, such as, residual water, from the steam generator thereby protecting the pump used for discharging the residual water and protecting the heater that beats the water in the steam generator.

Various advantages, objects, and features of the invention will be set forth in part in the written description and drawings that follow. Other advantages, objectives and features will become apparent to those having ordinary skill in the art based on the following description and drawings and/or from practicing the invention.

In accordance with one aspect of the present invention, the aforementioned advantages and objects are achieved by a method for controlling a dish washing machine that includes a steam generator. The method comprises a washing procedure that includes generating steam to aid in washing items that are in the dish washing machine. The method also comprises a water discharging procedure for discharging water in the steam generator.

In accordance with another aspect of the present invention, the aforementioned advantages and objects are achieved by a dish washing machine that comprises a tub which defines a dish washing space, in which items are washed, and a steam generator that supplies steam to the dish washing space to aid in washing the items. The steam generator, in turn, comprises a residual water outlet, through which, residual water in the steam generator is discharged.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention illustrate various aspects and embodiments of the present invention together with the description. In the drawings.

DETAILED DESCRIPTION OF THE INVENTION

Figure 1:
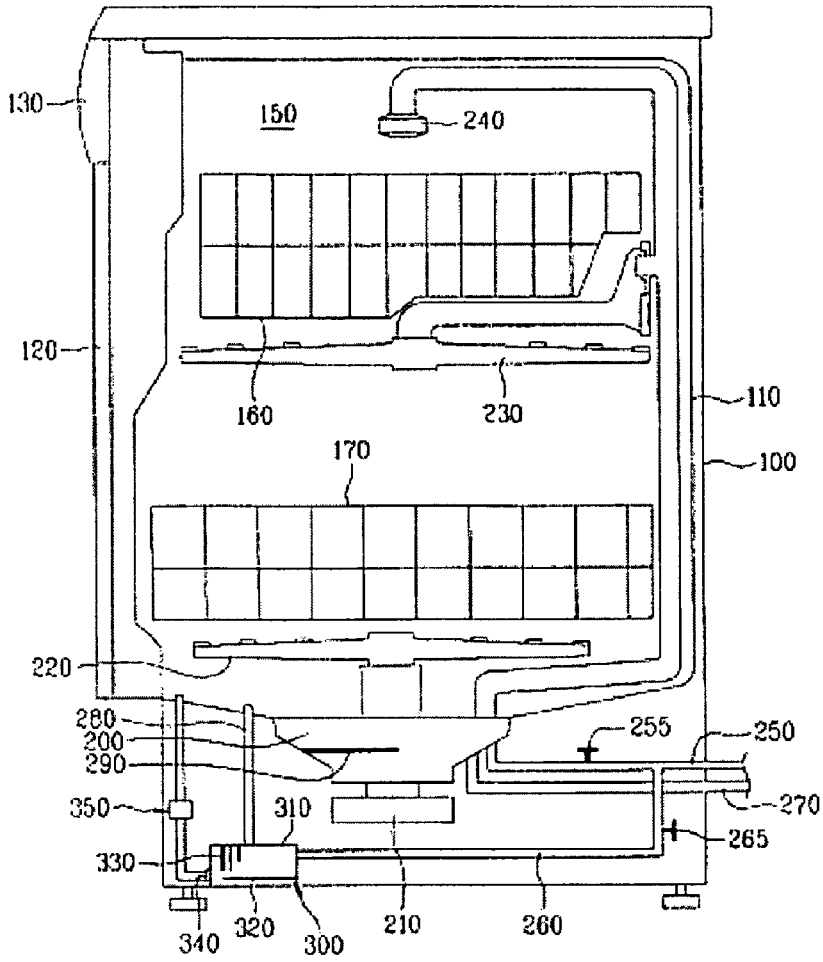
FIG. 1 is illustrates a dish washing machine according to an exemplary embodiment of the present invention.

FIG. 1 illustrates a dish washing machine according to an exemplary embodiment of the present invention. The dish washing machine includes, for example, a case 100 that defines the outer appearance of the dish washing machine. The dish washing machine also includes a door 120 and a control panel 130 mounted to the case 100 or to the door 120. The control panel 130 enables the user to operate the dish washing machine.

Turning now to the inside of the dish washing machine, a tub 110 is arranged within the case 100, the tub 110 defining a washing compartment 150 or space where the dishes are positioned during washing. Beneath the tub 110 is a sump 200, which collects wash water during the wash cycle. Located in the sump 200 is a pump 210 for pumping the wash water in the sump 200. A filter (not shown) for filtering contaminated wash water is also located in the sump 200. Still further, there is a first heater 290 arranged in the sump 200 to heat the wash water in the sump 200.

The dish washing machine further includes a first water supply conduit (e.g., a pipe or tube) 250 connected to the sump 200. The first water supply 250 supplies fresh water from an external water supply source to the sump 200. A water drainage conduit 270 is also connected to the sump 200, which drains the wash water from the sump 200 to a location external to the dish washing machine. A first water supply valve 255 for controlling the supply of fresh water to the sump 200 is positioned in the first water supply conduit 250, as shown.

At least one rack is arranged within the tub 110, that is, within the washing compartment 150. At least one spray arm is also arranged in the washing compartment 150, to spray towards at least one rack and the dishes positioned therein, the wash water that is pumped out of the sump 200 by the pump 210.

For illustration, FIG. 1 shows two racks, an upper rack 160 and a lower rack 170. These racks are arranged in an upper and lower portion of the washing compartment 150, respectively. FIG. 1 also shows an exemplary upper spray arm 230 and an exemplary lower spray arm 220, arranged such that the spray arms spray water provided by the pump 210 toward the upper rack 160 and the lower rack 170, respectively. In addition, a nozzle 240 may be arranged in a top portion of the washing compartment 150. The nozzle 240 sprays wash water provided by the pump 210 in a downward direction from the top portion of the washing compartment 150.

The dish washing machine according to the exemplary embodiment of the present invention illustrated in FIG. 1 is configured not only to spray wash water into the washing compartment 150, but to also spray or otherwise supply steam to the washing compartment 150. Accordingly, the dish washing machine illustrated in FIG. 1 includes a steam generator 300 for generating the steam that is supplied to the washing compartment 150. Preferably, the operation of the steam generator 300 is independent of the aforementioned first heater 290 in the sump 200.

In the exemplary embodiment shown in FIG. 1, the steam generator 300 communicates with the first water supply 250, via a second water supply conduit (e.g., pipe or tube) 260. The steam generator 300 also communicates with the washing compartment 150, via a steam supply conduit 280. A second water supply valve 265 for controlling the supply of water to the steam generator 300 is positioned in the second water supply conduit 260.

The steam generator 300 includes a case 310, which defines a space therein for containing the water supplied thereto. The steam generator 300 also includes a second heater 320 for heating the water contained in the case 310, and a water level sensor 330 for sensing the water level in the case 310.

The water level sensor 330 may be configured, for example, to sense a minimum water level and a maximum water level. The minimum water level is set so as to prevent the second heater 320 in the steam generator 300 from overheating. Thus, the ability to detect a minimum water level and, therefore, prevent the second heater 320 from overheating is a safety feature. To achieve this, the minimum water level should be set at a water level that is higher than the position of the second heater 320 within the steam generator 300. On the other hand, the maximum water level should be set to prevent water supplied to the steam generator 300 from overflowing.

In order to supply steam at a desired time, a steam supply valve (not shown) may be installed in the steam generator 300. The steam supply valve is configured to open and close the steam supply conduit 280.

A controller (not shown) is also provided to control the operation of the dish washing machine. The controller is electrically connected to the various electrical and electromechanical components, for example, the control panel 130, the pump 210, the heaters 290 and 310, the steam generator 300, and the valves to control the operation of the dish washing machine.

Hereinafter, the basic operation of the dish washing machine, according to exemplary embodiments of the present invention, will be described. When it is desired to wash dishes, the user places the dishes on the racks 160 and/or 170 and closes the door 120. Thereafter, the user selects the desired dish washing machine mode and initiates the operation of the dish washing machine using the control panel 130. During the operation of the dish washing machine, wash water is sprayed from the spray arms 220 and 230 and nozzle 240. The water eventually falls downward and into the sump 200. The wash water is then pumped out of the sump 200 by the pump 210, and is re-circulated to the spray arms 220 and 230 and nozzle 240. During the circulation of wash water from the sump 200 to the spray arms 220 and 230 and nozzle 240, the wash water is filtered to remove food residue. This prevents the wash water from becoming excessively dirty, and also to prevent the spray arms 220 and 230, as well as nozzle 240, from becoming clogged.

The dish washing machine according to the present invention, includes a steam generator 300, as previously stated. Thus, during certain wash cycles, the steam generator 300 generates steam, which is supplied to the washing compartment 150 via the steam supply conduit 280. The use of steam, as described herein, enhances the washing capability and efficiency of the dish washing machine, at least in part, because of the high-temperature and high-humidity properties of steam. For example, when dishes are washed using steam and wash water, foreign matter strongly adhering to the dishes more easily soaks up the moisture associated with the steam and wash water. Thus, the more thoroughly soaked foreign matter can be more effectively removed from the dishes. In addition, the dish washing machine, according to the present invention, more efficiently washes dishes because it is unnecessary to increase the pressure of the wash water of the wash water in order to remove foreign matter from the dishes, thus, less wash water is required.

Hereinafter, the basic operation of the steam generator 300 will be described. First, water is supplied to the steam generator 300, and stored within the case 310, via the second water supply conduit 260 when the second water supply valve 265 opens. The second water supply valve 265 closes, thereby shutting off the water being supplied to the steam generator 300, when a maximum water level is sensed by the water level sensor 330. The second heater 320 then heats the water contained in the steam generator 300. This generates steam, which is supplied to the washing compartment 250 via the steam supply conduit 280.

As the water in the steam generator 300 is converted to steam and, thereafter, is supplied to the washing compartment 150, the water level in the steam generator 300 begins to decrease. If the water level sensor 330 senses a minimum water level, the operation of the second heater 320 is stopped. The reason why the operation of the second heater 320 is stopped when the water level in the steam generator 300 reaches the minimum water level is to prevent any safety hazard caused by the second heater 320 overheating. Water is again supplied to the steam generator 300, if necessary, via the second water supply conduit 260, and the process repeats in this manner until the steam operation is completed.

Of particular importance here, is the fact that impurities are typically found in the water supplied to the steam generator 300. For example, calcium hydrocarbonate ($Ca(HCO_3)_2$) may exist in the water supplied to the steam generator 300 in dissolved form. Generally, this precipitates out in the form of calcium carbonate ($CaCO_3$), otherwise known as lime, when the water is heated. Thus, with each use of the steam generator 300, more and more calcium carbonate may precipitate out and continue to build up inside the steam generator 300. This problem may be particularly severe in Europe and American, where water tends to be relatively hard (i.e., contains a high concentration of impurities).

The water remaining in the steam generator 300, before or after a steam-washing cycle which, as stated, typically contains impurities, is referred to herein as residual water. The concentration of impurities is even greater in the water below the minimum water level. The reason being, as the impurities precipitate out, they settle in the water towards the bottom of the steam generator 300. The ever increasing concentration of impurities can damage the second heater 320, and ultimately result in a failure. This is because the impurities, such as lime, can erode the second heater 320.

Figure 2:
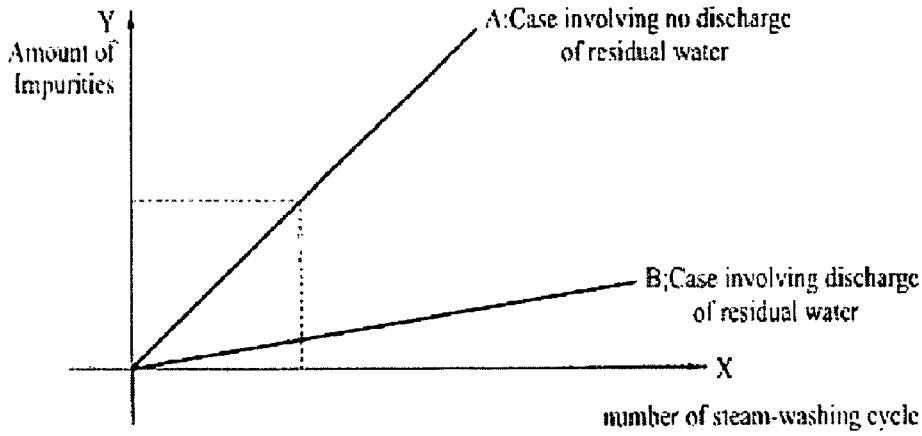
FIG. 2 is a graph depicting the relationship between the number of steam-washing cycles and the amount of impurities in the residual water.

FIG. 2 is a graph depicting the relationship between the number of steam-washing cycles and the amount of impurities that may exist in the residual water. In the graph, the X-axis represents the number of steam-washing cycles and the Y-axis represents the amount of impurities, such as lime, in the steam generator 300. In addition, plot "A" represents the case in which the residual water is not discharged (e.g., flushed) from the steam generator 300, and plot "B" represents the case in which the residual water is discharged from the steam generator 300. From a comparison of plot "A" and plot "B", it is evident that discharging the residual water in the steam generator 300 is desirable as plot "B" reflects a lower concentration of impurities than "A". Accordingly, it is of particular interest herein to describe a dish washing machine, including a steam generator and a method of removing impurities, such as calcium, magnesium and other impurities, by discharging the residual water in the steam generator 300.

Figure 3:
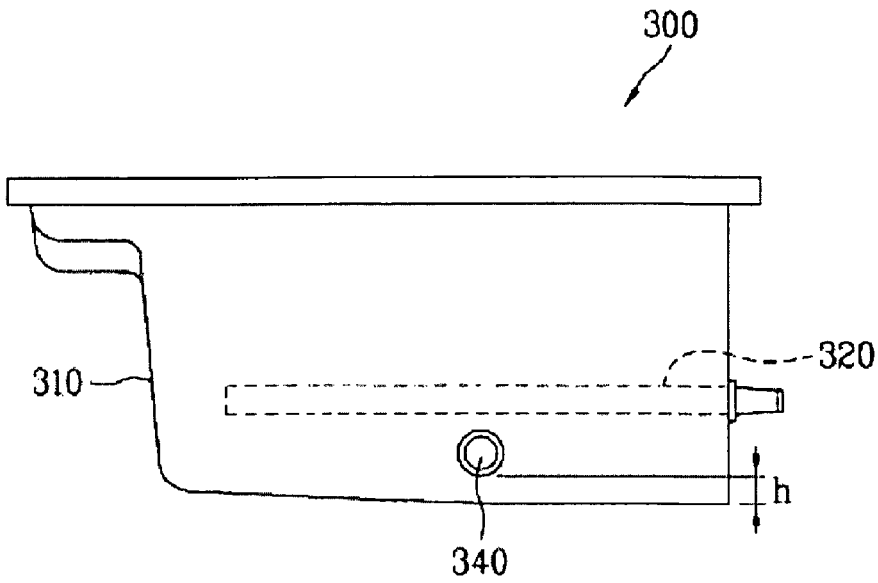
FIG. 3 illustrates a steam generator in accordance with exemplary embodiments of the present invention.

FIG. 3 is a more detailed view of the steam generator 300, according to an exemplary embodiment of the present invention. As shown, the steam generator 300 includes a residual water outlet 340, through which, residual water is discharged. Preferably, the residual water outlet 340 may be positioned at a height "h" above the bottom of the case 310, as shown. Alternatively, the residual water outlet 340 may be positioned at the bottom of the case 310. In the latter case, it is possible to completely discharge the residual water from the case 310 and, therefore, further reduce the amount of impurities. However, if the residual outlet 340 is positioned at the bottom of the case 310, doing so may increase the likelihood of damaging the pump 351, shown in FIG. 4, which will be discussed in more detail below. More specifically, larger impurity particles tend to accumulate at the bottom of the case 310, as compared to smaller impurity particles. If the residual water outlet 340 is at the very bottom of case 310, the larger particles are more likely to be discharged through, for example, pump 351. The exposure of pump 351 to these particles increases the likelihood of damaging the pump.

When the residual water outlet 340 is positioned at a certain height, for example, the height "h", as described above, it is possible to minimize the risk of damage to pump 351, while at the same time reducing the amount of impurities, particularly, smaller particles in the water in case 310.

In addition to preferably positioning the residual water discharge outlet 340 a height "h" above the bottom of the steam generator case 310, the residual water outlet 340 may be further positioned below the second heater 320. By doing this, the risk of damaging the second heater 320 is minimized, that is because, the exposure of the second heater 320 to impurities is reduced, due to the fact that the level of the residual water in the case 310 is below the position of the second heater 320, thereby, isolating the second heater 320 from the impurities.

Figure 4:
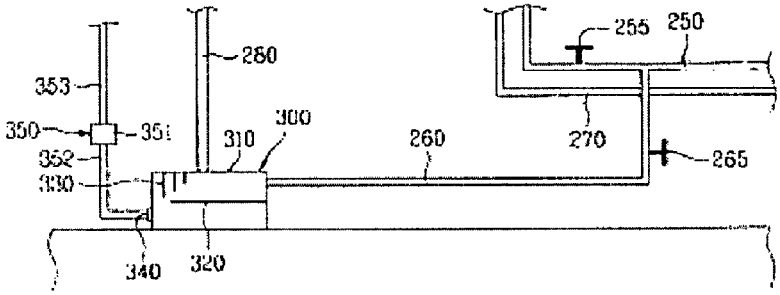
FIG. 4 illustrates an exemplary embodiment of a residual water discharging unit according to exemplary embodiments of the present invention.

FIG. 4 illustrates an exemplary embodiment of the present invention, wherein the aforementioned pump 351 is included in the residual water discharging unit 350. Pump 351 is provided, for example, as shown. This embodiment of the residual water discharging unit 350 also includes a first connecting conduit 352, which connects pump 351 to the residual water outlet 340. The residual water discharging unit 350 further includes a second connecting conduit 353 connected to pump 351, and at the other end thereof, it opens into tub 110.

In accordance with the exemplary embodiment illustrated in FIG. 4, the residual water in case 310 can be discharged into the interior of tub 110, i.e., into the washing compartment 150, through the use of pump 351, and eventually, the water is drained from the dish washing machine via the water drainage conduit 270.

Figure 5:
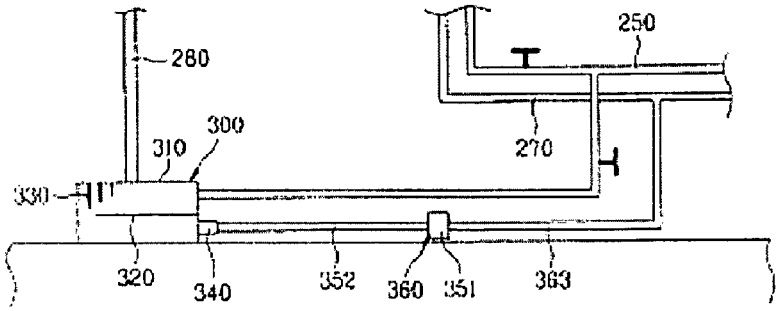
FIG. 5 illustrates an alternative exemplary embodiment of the residual water discharging unit according to the present invention.

FIG. 5 illustrates another exemplary embodiment of the present invention, wherein the residual water discharging unit 360 includes a pump 351 and a second connecting conduit 363, as shown. Specifically, the conduit 363 is connected, at one end thereof, to pump 351, and at the other end thereof, to water drainage conduit 270.

In accordance with this exemplary embodiment, the residual water discharging unit 360 discharges the residual water in case 310 to water drainage conduit 270, which in turn, drains the residual water from the dish washing machine.

Figure 6:
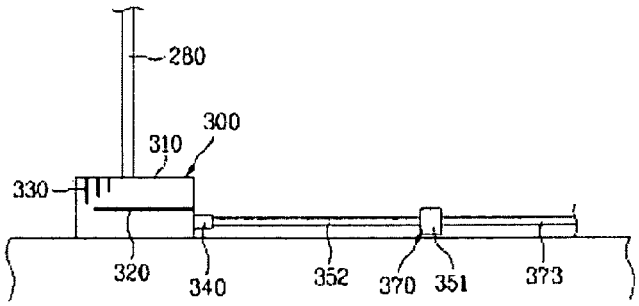
FIG. 6 is a view schematically illustrating yet another exemplary embodiment of the residual water discharging unit, according to the present invention.

FIG. 6 illustrates yet another exemplary embodiment of the present invention, wherein the residual water discharging unit 370 includes a pump 351 and a second connecting conduit 373. The second connecting conduit 373 is connected, at one end thereof, to pump 351. The second connecting conduit 373 is configured to discharge the residual water directly outside the dish washing machine.

We now turn our attention to the methods of discharging residual water in accordance with exemplary embodiments of the present invention. It should be noted, when the residual water in the steam generator 300 is discharged just after the generation of steam, the residual water discharging pump 351 may be damaged because the residual water in the case 310 is hot and because the pump 351 and the conduits are generally made, at least in part, using materials, such as rubber, which are subject to deformation if exposed to high-temperature residual water.

Of course, the discharging pump 351 and the corresponding conduits might be made from materials that are not subject to deformation when exposed to high-temperatures. However, this is undesirable due to increased manufacturing costs. Therefore, it is necessary that the method, in accordance with exemplary embodiments of the present invention, discharge the residual water from the steam generator 300 and, at the same time, prevent the residual water discharging pump 351 and/or the corresponding conduits from being damaged.

Figure 7:
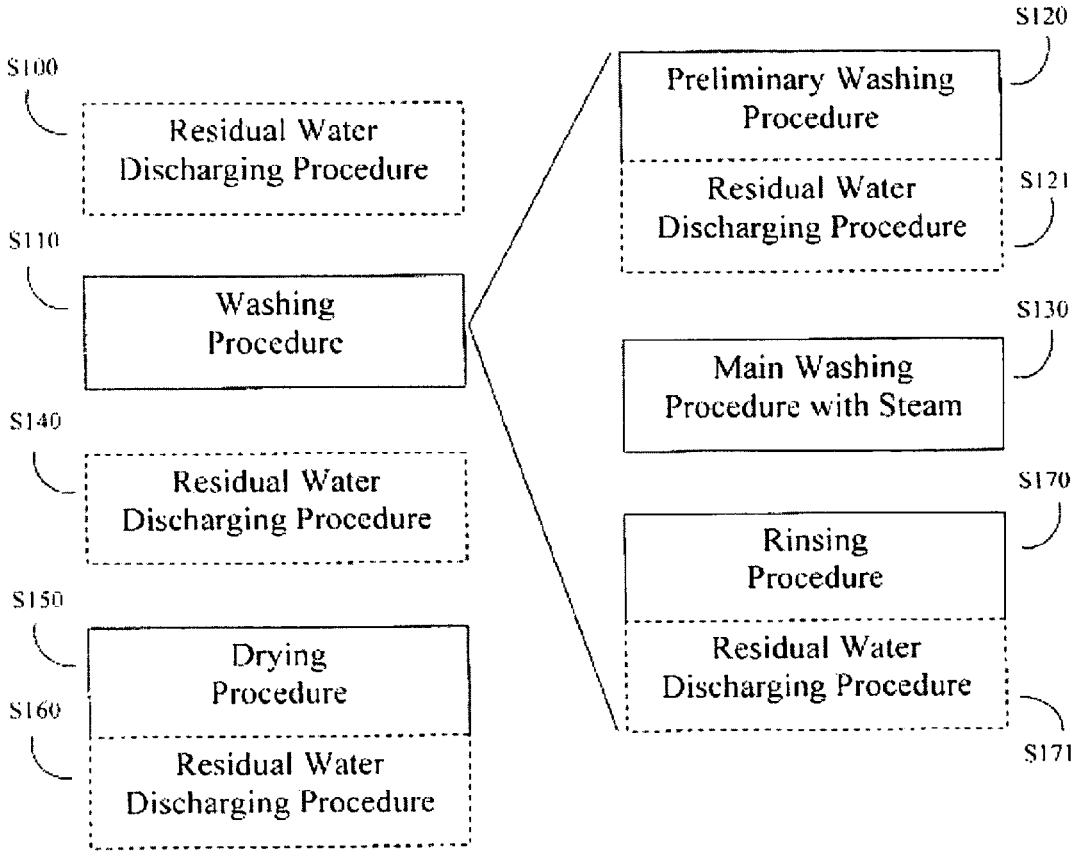
FIG. 7 is a flow chart illustrating a method for controlling a dish washing machine in accordance with exemplary embodiments of the present invention.

FIG. 7 is a flow chart illustrating a method for controlling the above-described dish washing machine, in accordance with exemplary embodiments of the present invention. As shown, the control method may include a residual water discharging procedure S100 for discharging water from the steam generator 300. In accordance with one exemplary embodiment of the present invention, the residual water discharging procedure S100 is executed prior to the generation of steam which occurs during the washing procedure. At this point, prior to the generation of steam, the residual water contained in the steam generator 300 has a relatively low temperature. Discharging the residual water at this point would be advantageous because there is little risk of damaging the discharge pump and, possibly, the corresponding conduits due to the temperature of the residual water in the steam generator.

The method illustrated in FIG. 7, of course, includes a washing procedure S110, which may involve two sub-procedures: a preliminary washing procedure S120, which uses wash water without steam, and a main washing procedure S130, which uses wash water and steam. During the preliminary washing procedure S120, the dishes may be washed using wash water with or without detergent. The primary purpose of the preliminary washing procedure S120 is to rinse the dishes so as to loosen or remove as much foreign matter attached to the dishes as possible.

As stated, the main washing procedure S130 is a procedure that employs not only wash water, but also steam. Wash water and steam maybe simultaneously sprayed during the main washing process S130. Alternatively, the main washing procedure S130 may involve a procedure for spraying steam on the dishes, and a separate, independent sub-procedure for spraying wash water on the dishes. The main washing procedure S130 may further involve repeating the above-described water and/or steam procedures.

In accordance with another exemplary embodiment of the present invention, where the washing procedure S110 involves a preliminary washing procedure S120 and a main washing procedure S130, it is possible to perform the residual water discharging procedure S121 after or during the preliminary washing procedure S120, as illustrated in FIG. 7. In the latter case, the total washing time can be minimized because no separate, dedicated time is needed to perform for the residual water discharging procedure S121. Again, there is no risk of damaging the residual water discharging pump 351 if the temperature of the residual water in the steam generator 300, at this point, is relatively low as the preliminary washing procedure S120 does not involve steam.

Referring again to FIG. 7, the control method according to still another exemplary embodiment of the present invention may include a residual water discharging procedure S140, to discharge water from the steam generator 300, after the execution of the washing procedure 110. In accordance with this exemplary embodiment, cold or cool water may be mixed with the water already contained in the steam generator 300 prior to discharging. This will lower the temperature of the residual water contained in the steam generator 300, thereby lessening the likelihood that the residual water discharging pump 351 will be damaged.

Alternatively, or in addition to mixing cold or cool water with the water in the steam generator 300, the residual water discharging procedure S140 may be performed after a given period of time elapses following the completion of the washing procedure S110. This time period would allow the temperature of the water in the steam generator 300 to drop to a relatively low temperature, thereby minimizing the likelihood of damage to the residual water discharging pump 351.

If the residual water discharging procedure S140 involves mixing cool or cold water with the water in the steam generator 300, or waiting a given time period to allow the residual water to cool down, it may be desirable to include a temperature sensor (not shown) in the steam generator 300. If so, the residual water discharging procedure S140 may be executed in response to the temperature sensor indicating that the water in the steam generator is sufficiently cool (i.e., that the temperature of the residual water is less than or equal to a predetermined temperature that will not damage the pump 351 and/or the corresponding conduits).

The control method, illustrated in FIG. 7, in accordance with yet another exemplary embodiment may include a drying procedure S150. During the drying procedure 150, cold or hot air may be introduced into the washing compartment 150 to dry the dishes. If the method employs a drying procedure S150, the residual water discharging procedure S160 may be performed after or during the drying procedure S150, as shown. As in the previous embodiment, it may be desirable to permit the water in the steam generator to sufficiently cool by waiting a given period of time or by mixing cool or cold water with the water contained in the steam generator 300. Again, employing a temperature sensor may facilitate this process by providing an indication when the water in the steam generator 300 has sufficiently cooled.

In accordance with another exemplary embodiment of the present invention, the washing procedure S110 may include a rinsing procedure S170. The rinsing procedure S170 involves spraying fresh wash water, that is, water containing no detergent, onto the dishes. The rinsing procedure S170 would be performed after the main washing procedure S130. In this embodiment, the residual water discharging procedure S171 may be performed after or during the rinsing procedure S170, as illustrated in FIG. 7. Again, it may be advantageous to mix cool or cold water with the water in the steam generator 300 or wait a given time period before performing the residual water discharging procedure S171, for the reasons stated above. Further, a temperature sensor may be employed, again, for the reasons previously stated.

It should be noted that each of the residual water discharging procedures S100, S121, S140, S160 and S171 appear in FIG. 7 with "dashed" lines. This is to illustrate that while performing only one residual water discharging procedure during the course of a single dish washing operation is the most likely scenario, it is within the scope of the present invention to perform more than one residual water discharging procedure during a dish washing operation, in accordance with any one or more of the aforementioned exemplary embodiments.

It will be apparent to those skilled in the art that modifications and variations of the present invention are possible without departing from the spirit of and/or scope of the present invention. Thus, it is intended that present invention covers these modifications and variations provided they come within the scope of the appended claims and their equivalence.

What is claimed is:

1. A dish washing machine comprising:

a tub which defines a dish washing space in which items are washed;

a steam generator supplying steam to the dish washing space to aid in washing the items, the steam generator comprising:

a case having a bottom wall and a side wall for containing water supplied thereto;

a heater provided in the case for heating the water in the case;

a residual water outlet, through which, residual water in the steam generator is discharged, wherein the residual water outlet is provided in the side wall of the case so as to be positioned between the heater and the bottom wall of the case, and the bottom of the residual water outlet is positioned at a predefined height above the bottom wall of the case.

2. The dish washing machine according to claim 1 further comprising:

a residual water discharging unit connected to the residual water outlet, through which, the residual water in the steam generator is discharged.

3. The dish washing machine according to claim 2, wherein the residual water discharging unit comprises a pump.

4. The dish washing machine according to claim 3, wherein the residual water discharging unit further comprises a first conduit connected to the pump.

5. The dish washing machine according to claim 4, wherein the first conduit is connected to the tub, thereby discharging the residual water in the steam generator into the dish washing space.

6. The dish washing machine according to claim 4, wherein the first conduit is connected to a water drainage conduit, thereby discharging the residual water out of the dish washing machine.

7. The dish washing machine according to claim 4, wherein the first conduit directly discharges the residual water out of the dish washing machine.

* * * * *